United States Patent [19]

Marbacher

[11] 4,236,374

[45] * Dec. 2, 1980

[54] YARN TAKE-UP AND SUPPLY MECHANISM FOR USE WITH TEXTILE MACHINES

[75] Inventor: Lothar Marbacher, Krefeld, Fed. Rep. of Germany

[73] Assignee: Palitex Project Company GmbH, Krefeld, Fed. Rep. of Germany

[ * ] Notice: The portion of the term of this patent subsequent to Oct. 10, 1995, has been disclaimed.

[21] Appl. No.: 3,997

[22] Filed: Jan. 17, 1979

[30] Foreign Application Priority Data

Jan. 19, 1978 [DE] Fed. Rep. of Germany ..... 2802205

[51] Int. Cl.[3] ..... D01H 15/00; D01H 1/10

[52] U.S. Cl. ..... 57/279; 57/58.7; 57/261

[58] Field of Search ..... 57/58.49–58.7, 57/279, 280, 261, 58.83–58.86; 139/452; 242/47–47.17

[56] References Cited

U.S. PATENT DOCUMENTS

| | | | |
|---|---|---|---|
| 3,731,478 | 5/1973 | Franzen | 57/279 X |
| 3,975,893 | 8/1976 | Franzen | 57/279 |
| 4,118,919 | 10/1978 | Marbacher | 57/58.7 X |
| 4,127,983 | 12/1978 | Munker | 57/279 |

*Primary Examiner*—John Petrakes

*Attorney, Agent, or Firm*—Bell, Seltzer, Park & Gibson

[57] ABSTRACT

A yarn take-up and supply mechanism for selected intermittent use with textile machines, such as a two-for-one twister, utilizing yarn, such as during a threading-up operation of the machine, characterized by a construction for receiving a free end of yarn from the textile machine, taking-up a loop of a predetermined length of the yarn and completely releasing the free end and taken-up length of yarn to the textile machine in a substantially tension-free condition. The mechanism includes clamping devices for receiving the free end of yarn extending from the textile machine and for clamping the free end of yarn, driven take-up devices for engaging the yarn inwardly of the clamped free end and for moving away a predetermined distance to carry the yarn and form a loop of a predetermined length of the yarn, and devices for releasing the clamping devices and the free end of yarn and for releasing the loop of yarn from the take-up devices for presentation of the free end of yarn and the taken-up length of yarn in a substantially tension-free condition to the textile machine. Preferably, the mechanisms further include yarn injector/ejector pneumatic devices for selectively creating a suction air flow to inject the free end of yarn into the clamping devices and for subsequently selectively creating a positive air flow to eject the free end of yarn from the clamping devices back to the textile machine after the take-up devices have formed a loop of a predetermined length of the yarn.

21 Claims, 13 Drawing Figures

145
148
179
100
101
124
121
122
177
176
150
151
140
123
111
102
174
171
170
143
142
30
29
37
71
Y
106
103
P
26
33
7
145
148
100
101
179
120
104
122
121
177
176
150
151
140
106
30
29
25
37
71
33
26
103
111
145
121
179
100
101
103
178
177
176
148
150
146
151
107
106
140
Y
71

YARN TAKE-UP AND SUPPLY MECHANISM FOR USE WITH TEXTILE MACHINES

This invention relates to a yarn take-up and supply mechanism for use particularly with textile machines processing yarns, such as during an automatic threading-up operation of a two-for-one twister or the like yarn processing machine, characterized by a construction for receiving a free end of yarn from the textile machine, taking-up a loop of a predetermined length of the yarn and completely releasing the free end and taken-up length of yarn to the textile machine in a substantially tension-free condition.

BACKGROUND OF THE INVENTION

In textile machines which process yarn, it is often necessary to provide a mechanism for taking-up of a predetermined length of yarn and for supplying of this yarn to the textile machine for various purposes. This is particularly true in the case of two-for-one twister textile yarn processing machines utilizing pneumatic or other types of automatic threading mechanisms for threading-up the spindle assemblies thereof upon starting-up of the spindle assembly or following breakage of the yarn during yarn processing. Such two-for-one twister textile yarn processing machines with pneumatic threading mechanisms for threading-up the spindle assemblies are disclosed in U.S. Pat. No. 3,731,478, issued May 8, 1973, and U.S. Pat. No. 3,975,873, issued Aug. 24, 1976, both of which are assigned to the assignee of the present invention.

As may be seen in each of these U.S. Patents, in order to accomplish suitable pneumatic threading-up of the spindle assemblies of these machines, the yarn must be pulled from the supply package of yarn and supplied to the entry of the yarn passageway through the spindle assembly in a substantially tension-free condition so that the suction and positive air stream created through the yarn passageway in the spindle assembly by the pneumatic threading mechanisms can effectively thread the yarn therethrough. Often, problems have existed with respect to removing the yarn from the supply package and supplying it to the passageway in the spindle assembly for automatic pneumatic threading in a substantially tension-free condition. Accordingly, there is a need, particularly in these types of twisting machines, for a yarn take-up and supply mechanism which can take-up a given length of yarn and supply this yarn to the textile machine in a substantially tension-free condition.

Heretofore, yarn take-up and supply mechanisms, also called yarn regulating devices, have been typically used in weaving and knitting machines and were instrumental in insuring the slip-free positive supply of fixed lengths of yarn at high running speeds to these machines. However, in these types of take-up and supply mechanisms, the yarn runs onto one end of a take-up drum from a supply package and is passed directly into the textile machine, such as a circular knitting machine, from the other end of the drum. An axial displacement of the yarn windings on the drum takes place along the surface of the drum and the mechanisms are continuously utilized during the supply of yarn from the supply packages to the textile machine and remain in the feeding path or zone of yarn flow during the entire machine operation.

Accordingly, these previously known yarn take-up and supply mechanisms could not be utilized for intermittently taking-up and supplying of a given length of yarn in a substantially tension-free condition to an associated textile machine and which would thereafter not be in the normal path of travel of the yarn through the textile machine during processing of the yarn therein.

Therefore, a need existed for a take-up and supply mechanism which could be intermittently used, for example at selective spindle assemblies of a textile yarn processing machine, for taking-up a given length of yarn and supplying this given length of yarn to the textile machine in a substantially tension-free condition for use in pneumatic or other threading of such textile machines. To fulfill this need, such a take-up and supply mechanism was proposed in applicant's U.S. Pat. No. 4,118,919, issued Oct. 10, 1978, and assigned to the assignee of the present application. Applicant's patent also discloses in the specification thereof U.S. patents setting forth the prior type of take-up and supply mechanisms, described above, which were typically utilized in weaving and knitting machines and which remained in the feeding path of the yarn flow during the entire machine operation and such prior art patents are incorporatd herein by reference along with German Patent Publication 1,063,537.

In applicant's U.S. Pat. No. 4,118.919, a yarn take-up and supply mechanism was provided which utilized a rotating drum mechanism for winding a given length of yarn on the outside surface thereof for subsequently supplying this wound length of yarn to the textile machine in a substantially tension-free condition. Although the yarn take-up and supply mechanism of applicant's prior U.S. Pat. No. 4,118,919 was a substantial improvement over prior yarn take-up and supply mechanisms and provided, for the first tme, a yarn take-up and supply mechanism which could be intermittently operated at a desired location, such as a particular spindle assembly, in a textile machine and which would not remain in the feeding path of yarn flow during the entire machine operation, this prior patented mechanism was necessarily complex in design and expensive to manufacture due to the use of the rotating drum.

OBJECTS AND SUMMARY OF THIS INVENTION

Accordingly, it is the object of this invention to overcome the above-described problems and to provide an improved yarn take-up and supply mechanism for use with textile machines utilizing yarn, such as during a threading-up operation of the machine, which is characterized by a construction for receiving a free end of yarn from the textile machine, taking-up a loop of a predetermined length of the yarn and completely releasing the free end and taken-up length of yarn to the textile machine in a substantially tension-free condition.

It is a further more specific object of this invention to provide such a yarn take-up and supply mechanism which eliminates the necessity of the use of a rotating drum for coiling of yarn thereon and which may be more easily and inexpensively constructed.

In accordance with this invention, it has been found that the above objects may be accomplished by providing such a yarn take-up and supply mechanism which comprises broadly the following.

Housing means are provided. Clamping means are carried by the housing means for receiving the free end of yarn extending from the textile machine and for clamping the free end of yarn. Driven take-up means are carried by the housing means for engaging the yarn inwardly of the clamped free end and for moving away a predetermined distance to carry the yarn and form a loop of a predetermined length of the yarn. Means are carried by the housing means for releasing the clamping means and the free end of yarn for presentation to the textile machine. Means are carried by the housing means for releasing the loop of yarn from the take-up means for presentation in a substantially tension-free condition to the textile machine.

Preferably, yarn injector/ejector pneumatic means are operatively associated with the clamping means for selectively creating a suction air flow to inject the free end of yarn from the textile machine into the clamping means and for subsequently selectively creating a positive air flow to eject the free end of yarn from the clamping means back to the textile machine after the take-up means has formed a loop of a predetermined length of the yarn.

The above broadly described yarn take-up and supply mechanism of this invention may be desirably utilized with a textile yarn processing machine, such as a two-for-one twister or the like having a plurality of spindle assemblies each including a driven rotating rotor mechanism, a stationary carrier mechanism for carrying a hollow supply package of yarn, and an elongate yarn passageway passing downwardly through the top of the carrier mechanism along the axis of the spindle assembly and radially outwardly through the rotor mechanism for receiving the yarn from the supply package therethrough and then upwardly along the outside of the carrier mechanism for forming a rotating balloon of yarn during yarn processing. The textile yarn processing machine may further include selectivelyoperable pneumatic threading mechanisms for being operated to automatically thread yarn withdrawn from the supply package through the passageway during threading-up of the spindle assembly by creating a suction through the yarn entry portion of the passageway and a positive airstream through the yarn exit portion of the passageway.

When the improved yarn take-up and supply mechanism of this invention is utilized in such a textile yarn processing machine, it may be conveniently positioned on and carried by a trolley mechanism mounted for movement along the outside of such textile machine and along the front of each of the spindle assemblies so that the yarn take-up and supply mechanism may be conveniently positioned in front of a respective spindle assembly when a yarn take-up and supply operation is desired.

BRIEF DESCRIPTION OF THE DRAWINGS

While some of the objects and advantages along with a broad description of this invention have been set forth above, other objects, advantages and a more detailed description of the construction of the mechanism of this invention will appear as the description proceeds, when taken in conjunction with the following drawings, in which.

DESCRIPTION OF PREFERRED EMBODIMENT

While the drawings and specific description to follow will be related to a two-for-one twister textile yarn processing machine, which is the preferred textile machine utilizing the improved yarn take-up and supply mechanism of this invention, it is to be understood that this yarn take-up and supply mechanism could be utilized with other textile machines for which a take-up and supply function of the yarn is desired.

Figure 1:
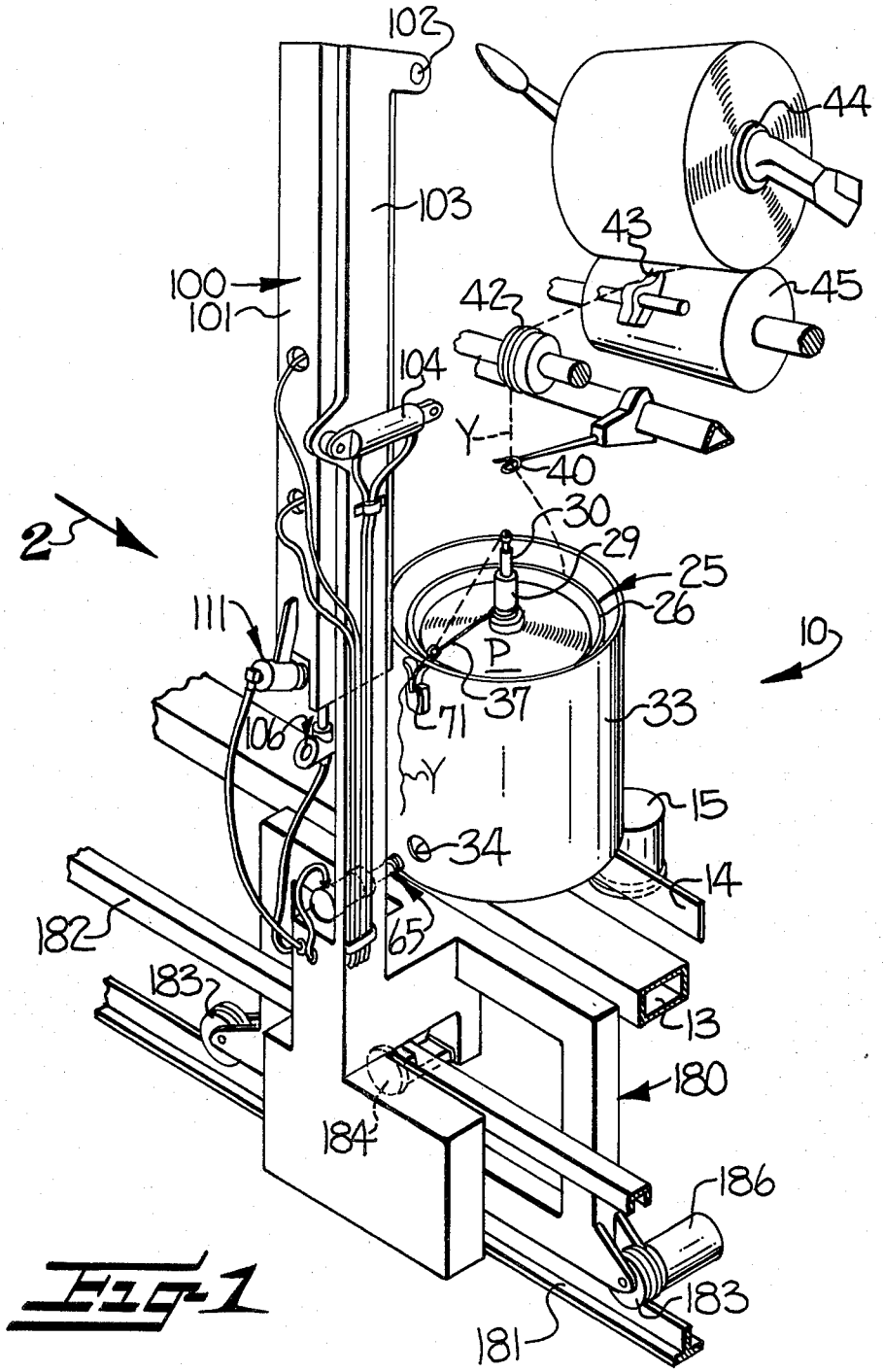
FIG. 1 is a somewhat schematic, perspective view, of one spindle assembly station of a two-for-one twister textile yarn processing machine utilizing the yarn take-up and supply mechanisms of this invention.

Referring now to the drawings, there is illustrated in FIG. 1 a schematic perspective view of a single spindle assembly station, generally indicated at 10, of a two-for-one twister textile yarn processing machine. It is to be understood that a plurality of these spindle assembly stations 10 are provided in a two-for-one twister in side-by-side relationship in two rows along the outside of the machine. A full illustration and description of the entire two-for-one twister is not given herein and is not believed to be necessary for an understanding of the present invention, the operation and complete structure of such two-for-one twisters are well understood to those with ordinary skill in the art.

Figure 2:
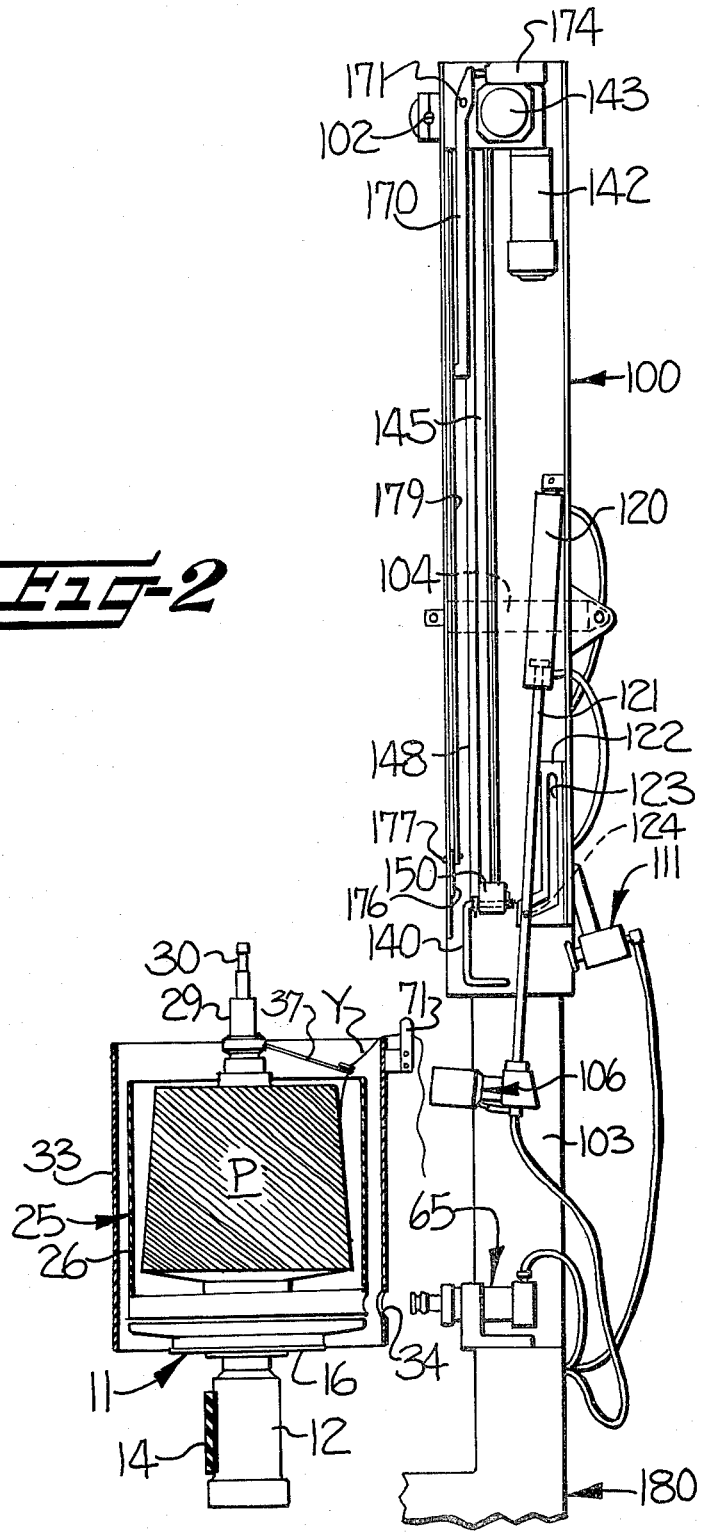
FIG. 2 is a side elevational view, with parts thereof in section, taken generally in the direction of the arrow 2 of FIG. 1.
Figures 3, 4:
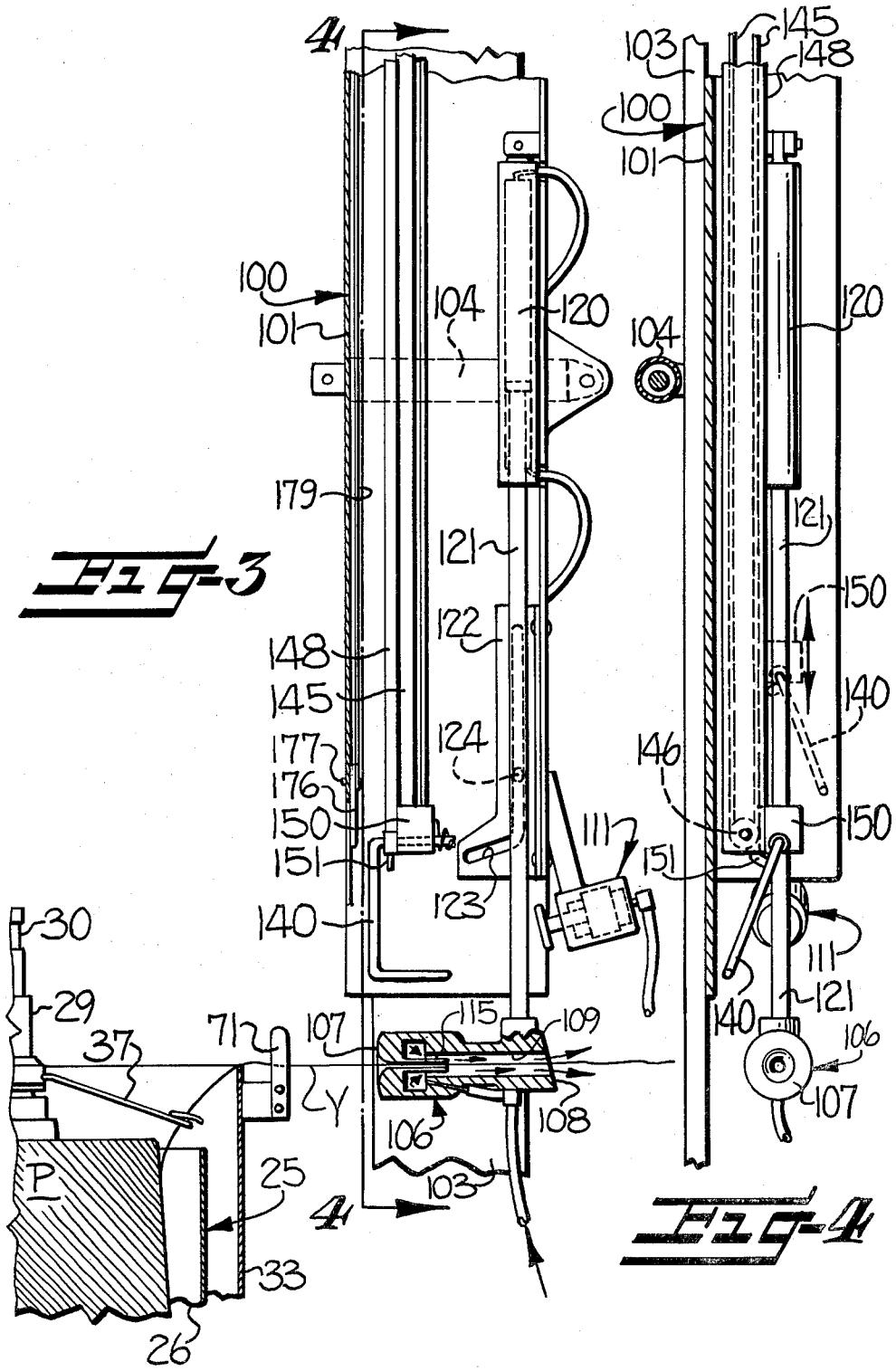
FIG. 3 is an enlarged partial side elevational view, with parts in section, illustrating the yarn injector of this invention in operation.
FIG. 4 is a sectional view, taken generally along the line 4—4 of FIG. 3.
Figures 5, 6, 7:
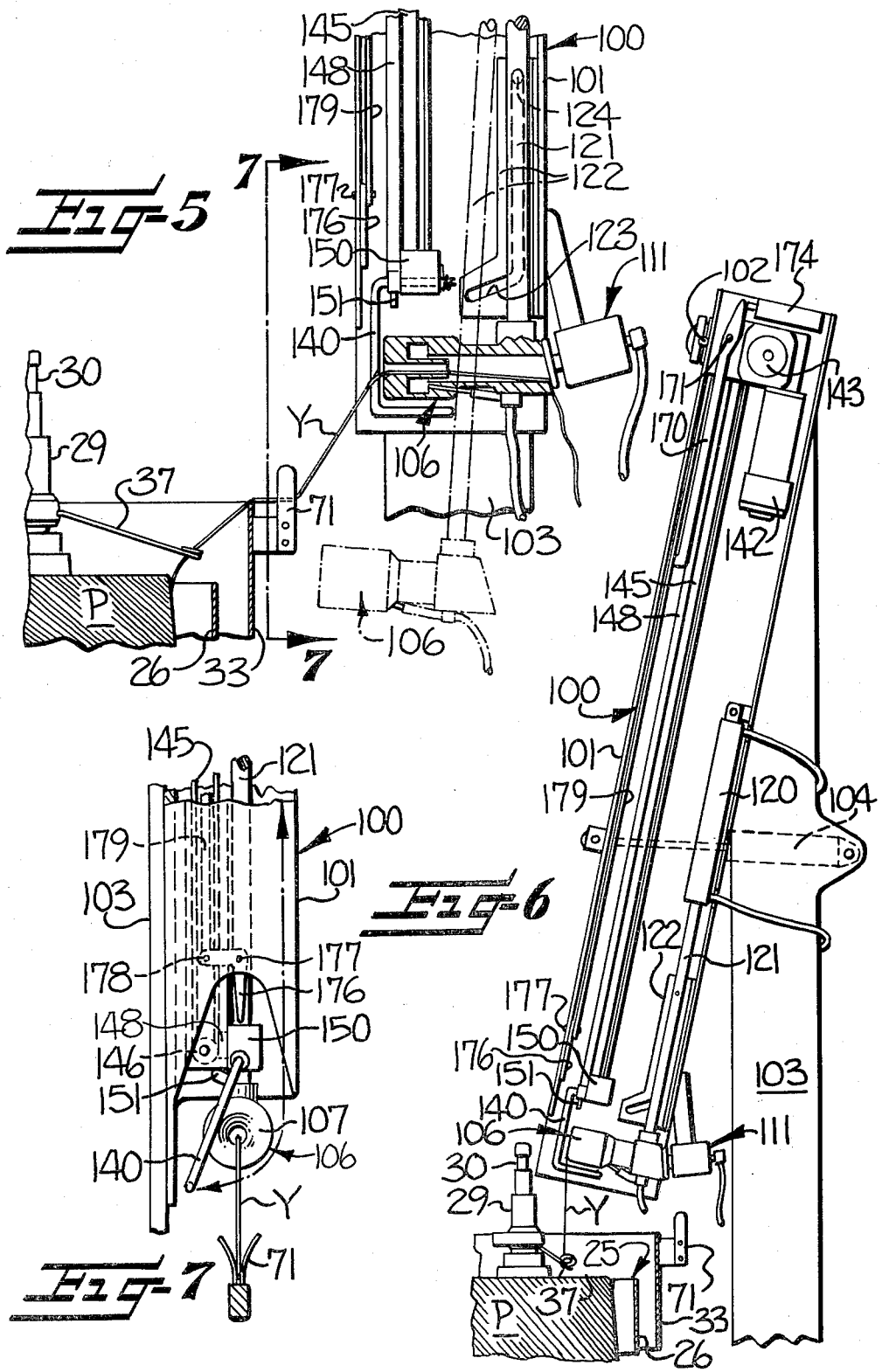
FIG. 5 is a partial sectional elevational view illustrating the clamping means moving into clamping position.
FIG. 6 is a sectional elevational view illustrating the housing of the mechanism of this invention being moved from its first to its second position for ejecting of the free end and taken-up length of yarn.
FIG. 7 is a partial sectional view, taken generally along the line 7—7 of FIG. 5.
Figure 8:
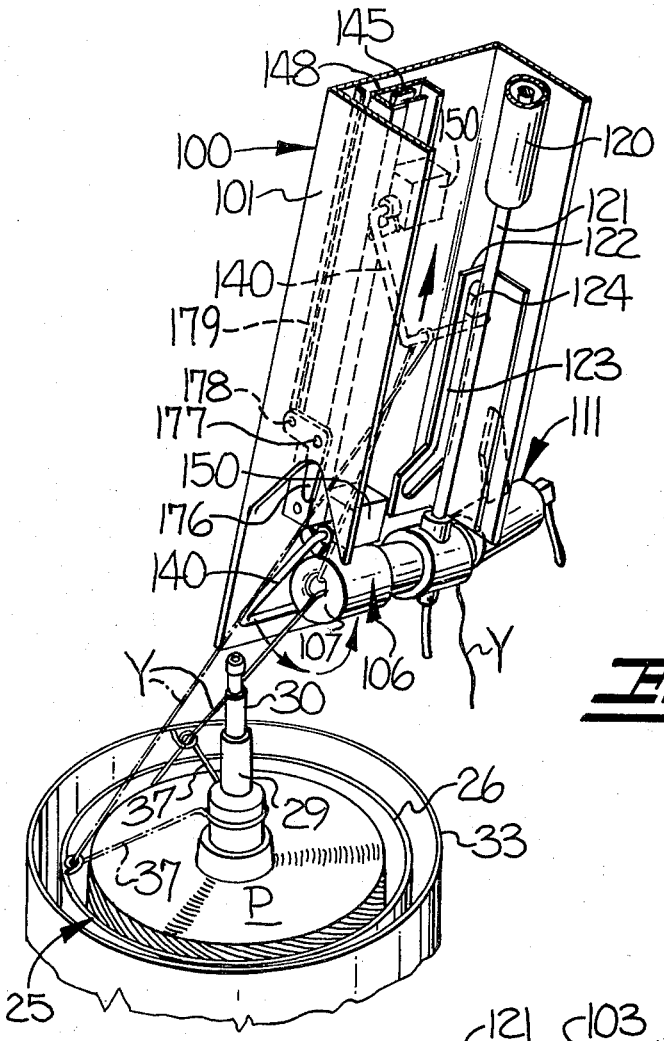
FIG. 8 is a partial perspective view illustrating the take-up means being moved from its first to its second position for taking-up a loop for yarn.

Each of the spindle assemblies 10 (see FIGS. 1, 2 and 10 particularly) comprise a rotatably driven rotor mechanism, generally indicated at 11, which includes a whorl portion 12 suitably rotatably mounted on a portion of the twister frame 13 and rotated by a continuous, tangential, drive belt 14 in a manner well understood by those with ordinary skill in the art. Tension rolls 15 are associated with each spindle assembly station 10 and are pivotally mounted for engaging and holding the drive belt 14 in tight driving engagement with the whorl portion 12 for normal rotation of the rotor mechanism 11 of the spindle assembly 10.

The rotor mechanism 11 further includes a horizontally-extending yarn reserve disc device 16 secured to the whorl 12 for rotation therewith and a generally vertically-extending hollow axle device 17 which also rotates with the reserve disc 16. The reserve disc 16 and hollow axle device 17 define therewithin a generally L-shaped yarn passageway 20 extending generally vertically through the hollow axle device 17 and a portion of the yarn reserve disc 16 and generally horizontally and radially out of the yarn reserve disc 16.

The spindle assembly station 10 further includes a stationary carrier mechanism, generally indicated at 25, for supporting and carrying a hollow package P of yarn Y and which is rotatably mounted on rotor mechanism 11 (see FIG. 10) so that the rotor mechanism 11 may rotate relative thereto. The carrier mechanism 25 (see FIG. 10) comprises a basket device 26 which surrounds the package P of yarn Y, a circular bottom portion 27 for supporting the hollow yarn supply package P and a hollow hub portion 28 extending into the hollow yarn supply package P for stabilizing the yarn supply package. The hollow hub portion 28 may include a hollow yarn package carrier member 29 in partial telescoping relationship therein which carries a hollow yarn entry tube 30 at the upper end thereof. As may be seen particularly in FIG. 10, the hollow axle device 17 of the rotor mechanism 11 extends into the hollow hub portion 28 of the carrier mechanism 25 and the carrier mechanism 25 is rotatably mounted on the rotor mechanism 11 by means of bearings 32, so that the rotor mechanism 11 may rotate relative to the stationary carrier mechanism 25 which is held stationary by any suitable means such as magnetic means 31.

The carrier mechanism 25 including the carrier member 29, the yarn entry tube 30 and the hollow interior of the hub portion 28 define a generally vertically-extending passageway 31 which is disposed in axial alignment with the yarn passageway 20 through the rotor mechanism 11 and joins with the yarn passageway 20 for providing a continuous elongate yarn passageway 31, 20 passing downwardly through the top of the carrier mechanism 25, along the axis of the spindle assembly 10 and radially outwardly through the rotor mechanism 11, The spindle assembly station 10 further includes a stationary balloon limitor device 33 surrounding the basket device 26 of the carrier mechanism 25 and having an aperture 34 therein for purposes to be described below. There is further included a pigtail flyer mechanism 37 rotatably mounted on the carrier member 29 and a yarn guide eyelet 40 (see FIG. 1) positioned above and in axial alignment with the yarn entry tube 30 and the yarn passageway 31 therethrough. There is also included a pre-take-up roll 42, and yarn traversing mechanism 43 and a yarn take-up or package roll device 44 upon which the yarn Y is wound after being processed by the spindle assembly station 10. The package roll device 44 is rotated by friction drive roll 45 in a well-known manner.

With the above described mechanisms, the yarn Y is withdrawn from the package P, passes through the pigtail flyer mechanism 37, through the yarn entry tube 30 and the yarn passageway 31. From the passageway 31, the yarn passes through the generally L-shaped yarn passageway 20 of the rotating rotor mechanism 11 and out of the reserve disc 16. The yarn Y then passes upwardly between the basket device 26 and the balloon limitor 33 to form a rotating balloon of yarn Y as the rotor mechanism 11 is rotated. The yarn Y then passes through the yarn guide eyelet 40 which limits the upper end of the rotating balloon of yarn, over pre-take-up roll 42 and is traversed by traversing mechanism 43 onto the package roll device 44 to complete its travel through the respective spindle assembly station 10. As is well understood by those with ordinary skill in the art, a two-for-one twist is inserted in the yarn during the above-noted path of travel.

The spindle assembly station 10 further includes pneumatically-operated, yarn threading mechanisms for automatically threading yarn Y withdrawn from the supply package P through the yarn passageway 31, 20 during threading-up of the spindle assembly station 10. These automatic, pneumatic, threading mechanisms may be constructed generally in accordance with the above-mentioned, assignee's U.S. Pat. Nos. 3,975,873 or 3,731,478 or otherwise; however, the pneumatic threading-up mechanisms of assignee's U.S. Pat. No. 3,975,873 have been broadly illustrated and described herein.

Figure 10:
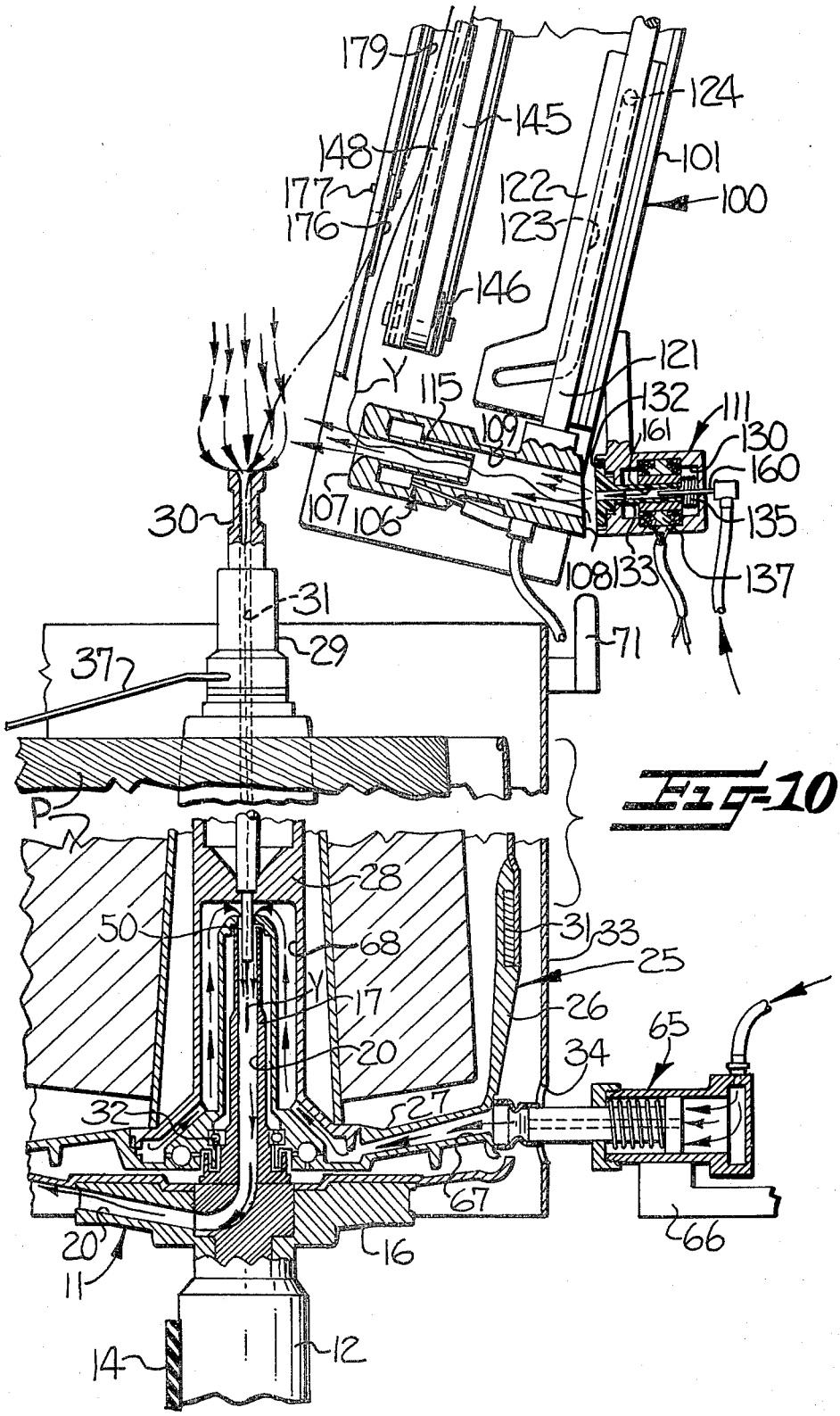
FIG. 10 is a partial elevational sectional view illustrating the mechanisms of this invention ejecting the free end of yarn after the take-up mechanism has taken-up a loop of such yarn and with the clamping means in the non-clamping position and illustrating the operation of the pneumatic threading mechanisms of the two-for-one twister textile yarn processing machine.

As may be seen in the drawings, particularly FIG. 10, these pneumatic threading-up mechanisms include a selectively operated, air injector nozzle, generally indicated at 50, which selectively receives air under pressure from a connector 65 leading from a suitable source of compressed air and which is movably mounted on an arm 66 for being moved into and out of engagement, through the aperture 34 in the balloon limitor 33, with an aperture 67 in the bottom portion 27 of the carrier mechanism 25. The aperture 67 leads by way of an air passageway 68 through the carrier mechanism 25 to the injector nozzle 50 for creating a positive airstream through the passageway 20 through the rotor mechanism 11 and a negative air flow or suction through the yarn passageway 31 of the carrier mechanism 25.

By the above arrangement, when the connector 65 is selectively inserted into the aperture 67 in the stationary carrier mechanism 25 by movement through the aperture 34 in the balloon limitor 33, the above-described airstreams will be created so that yarn Y pulled from the supply package P may be placed at the entry to the yarn passageway 31 through the yarn entry tube 30 and will be sucked into the passageway 31 to be pneumatically threaded therethrough and out of the yarn passageway 20 for automatic threading-up of the spindle assembly 10 during start-up or in the event of yarn breakage during yarn processing. The spindle assembly 10 may also include a yarn grip member 71 mounted on the upper end of the balloon limitor device 33 or other outside frame portion which includes a pair of resilient plate members forming a slot therebetween for receipt of a broken end or otherwise free end of yarn Y therein for holding the yarn Y and for easily releasing the yarn Y upon movement in an upward direction.

In accordance with this invention, the above-described textile yarn processing machine is provided with a yarn take-up and supply mechanism, generally indicated at 100, for use with the textile yarn processing machine and for cooperation with the pneumatic threading mechanism for receiving the free end of yarn Y from the spindle assembly 10, taking-up a loop of a predetermined length of the yarn Y and completely releasing the free end and taken-up length of yarn Y to the spindle assembly 10 in a substantially tension-free condition for receipt by the pneumatic threading mechanisms described above for automatic threading of the yarn Y through the spindle assembly 10.

The yarn take-up and supply mechanism 100 comprises an upstanding housing, generally indicated at 101 which is mounted at 102 on an upstanding frame member 103 for pivotal movement between a first position (FIGS. 1–5), during which the yarn take-up and supply mechanism 100 receives the yarn Y withdrawn from the supply package P in the spindle assembly 10 of the textile machine, and a second position (FIGS. 1–10), during which the yarn take-up and supply mechanism 100 releases the free end and taken-up length of yarn Y to the yarn entry portion of the passageway 31 through the yarn entry tube 30 of the package carrier mechanism 25 for pneumatic threading of the yarn Y by the above-described threading mechanisms through the spindle assembly 10. Means, which may be in the form of a pneumatic piston and cylinder mechanism 104 respectively attached to the upstanding frame member 103 and the housing 101, may be provided for moving the upstanding housing 101 between the above-described positions.

The yarn take-up and supply mechanism 100 further includes clamping means carried by the housing 101 for receiving the free end of yarn Y from the supply package P and preferably from the yarn grip member 71 and for clamping the free end of yarn Y. The clamping means comprises a first member 106 carried by the housing 101 and having a front end 107, a rear end 108 and a hollow interior 109 (see specifically FIGS. 3, 5 and 10) for receiving the free end of yarn Y at the forward end 107 to extend through the hollow interior 109 and out of the rear end 108. The clamping means further includes a second member 111 mounted for movement between a clamping position (FIG. 9) in engagement with the rear end 108 of the first member 106 and a non-clamping position (FIG. 10) out of such engagement.

For cooperation with the clamping means 106, 111, pneumatic yarn injector means are provided which comprise an injector nozzle 115 formed within the hollow interior of the passageway 109 through the first member 106 of the clamping means 106, 111 which receives air from any suitable source (FIG. 3) and causes an air flow through the hollow interior 109 of the first member 106 of the clamping means from the front end 107 to the rear end 108 so that when the first member 106 of the clamping means 106, 111 is placed in the vicinity of the free end of yarn Y contained within the yarn grip member 71, such free end of yarn Y will be injected into the hollow interior 109 of the first member 106 of the clamping means to extend therethrough and out of the rear end 108.

For suitably locating the first member 106 of the clamping means 106, 111 in such a position for injecting the free end of yarn Y therein, the first member 106 of the clamping means 106, 111 is mounted for movement from the first position (FIGS. 2 and 3) during which the yarn is injected therein, to a second position (FIG. 5) in which the rear end 108 of the first member 106 of the clamping means moves into engagement with the second member 111 of the clamping means. For ease in this engagement, the rear end 108 of the first member 106 of the clamping means maybe provided with an oblique face which may easily move into engagement with the second member 111.

The first member 106 is mounted for such movement between its first and second positions by a pneumatic cylinder and piston mechanism 120, 121 in which the cylinder 120 may be carried by the housing 101 and the piston 121 attached to the first member 106 of the clamping means 106, 111. There is also provided a guide groove 123 in a plate member 122 carried by the housing 101 which receives a guide pin 124 extending from and carried by the piston 121 and riding in the groove 122. The groove 122 may be reverse L-shaped so that the first member 106 will move from its first position (FIG. 2) in close proximity to the free end of yarn extending from the yarn grip 71, slightly rearwardly (FIG. 3) and then upwardly into clamping engagement (FIG. 5) with the second member 111 of the clamping means for clamping the free end of the yarn Y therebetween.

Figure 9:
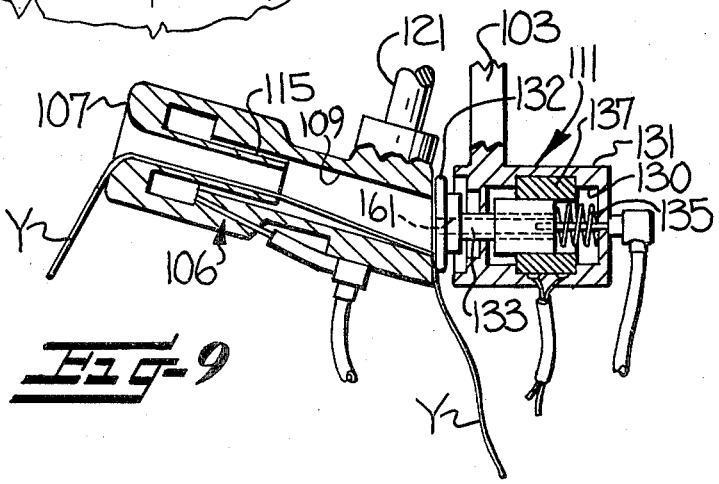
FIG. 9 is a partial sectional view through the clamping means.

As may be seen particularly in FIGS. 9 and 10, the second member 111 of the clamping means 106, 111 comprises a housing 131 having a hollow interior 130 which carries a movable plate 132 extending outwardly from the front of the housing 130 and having a hollow shaft 133 extending into the hollow interior 131. The plate member 132 is biased by a spring 135 into a forward extended position for clamping engagement with the rear end 108 of the first member 106 of the clamping means and may be moved to a second retracted position (FIG. 10) by any suitable means such as electrically actuated magnetic device 137. The housing 131 is carried in a stationary position by being secured to the upstanding housing 101.

The take-up and supply mechanism 100 further includes take-up means comprising a generally L-shaped hook member 140 for engaging one end thereof the yarn Y inwardly of the clamped free end (FIGS. 5, 6 and 7) and moving along a generally linear path of travel (FIG. 8) from the position of engagement of the yarn Y to a second position (FIG. 11) a predetermined distance away to carry the yarn Y therewith and form a loop (FIGS. 11 and 12) of a predetermined length of the yarn.

The means for mounting the hook member 140 and carrying the hook member 140 between its first and second positions comprises a suitable drive mechanism such as an electric motor 142 which drives a gear box 143 which drives a pulley 144 carrying one end of an endless belt 145 which also extends around an idler pulley 146. The belt 145 and pulleys 144, 146 are contained within a generally U-shaped guide member 148. The hook member 140 is pivotally mounted at its other end in a block member 150 which is secured to the belt 145 for movement therewith. The hook member 140 may also include a lug 151 which rides around the bottom of the U-shaped guide 148 (FIG. 7) for initial engagement of the yarn Y being held by the clamping means 106, 111 and then upwardly along the linear path of travel under the drive of motor 142, gear box 143 and belt 145 to its upper position for forming a loop of yarn Y of a predetermined length.

After formation of the loop for yarn Y, the clamping means 106, 111 are disengaged by movement of the clamping plate 132 by the magnetic means 137 to its non-clamping position (FIG. 10) to free the free end of yarn Y previously held by the clamping means 106, 111.

The take-up and supply mechanism 100 further includes pneumatic yarn ejector means comprising means for selectively creating a positive air flow through the hollow interior of the first member 106 of the clamping means 106, 111 from the rear end 108 to the front end 107 of the first member 106 for ejecting the previously clamped free end of yarn Y from the clamping means back to the textile machine when the first and second members 106, 111 of the clamping means are in such non-clamping position (FIG. 10).

While this is occurring, the piston and cylinder mechanism 104 has been actuated to move the housing 101 to its forward position (FIG. 10) so that the ejected free end of yarn Y will be ejected into the vicinity of the opening to the yarn entry tube 30 and the yarn passageway 31 therethrough and, due to the suction created therethrough by the pneumatic threading mechanisms, described above, this free end of yarn Y will be automatically sucked into and threaded through the spindle assembly 10.

The means for selectively creating the positive air flow for such pneumatic yarn ejector means may comprise an air tube 160 (FIG. 10) extendng through the hollow shaft 133 carrying the clamping plate 132 of the clamping means 106, 111 to expel a positive air flow out through an aperture 161 in the front of the clamping plate 132 which will cause an airstream through the hollow interior 109 of the first member 106 of the clamping means 106, 111.

Figure 12:
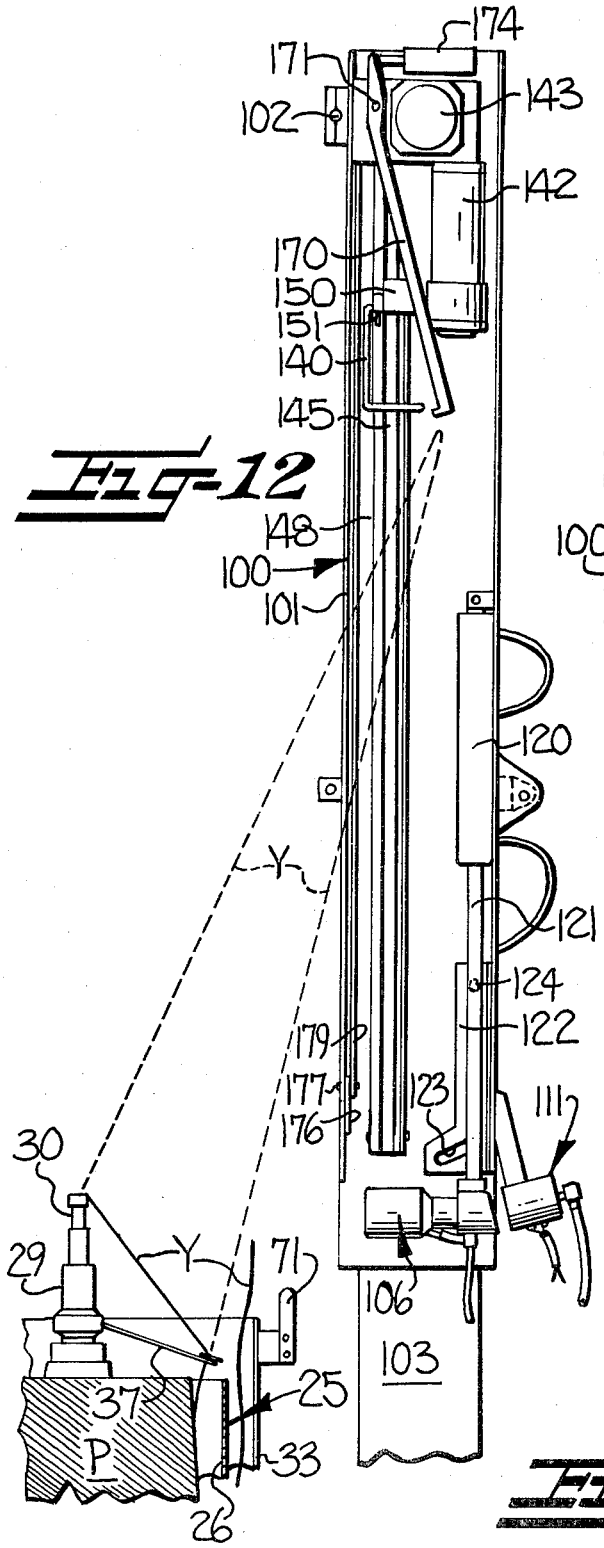
FIG. 12 is a partial sectional elevational view illustrating the means for releasing the taken-up loop of yarn from the take-up means.
Figure 11:
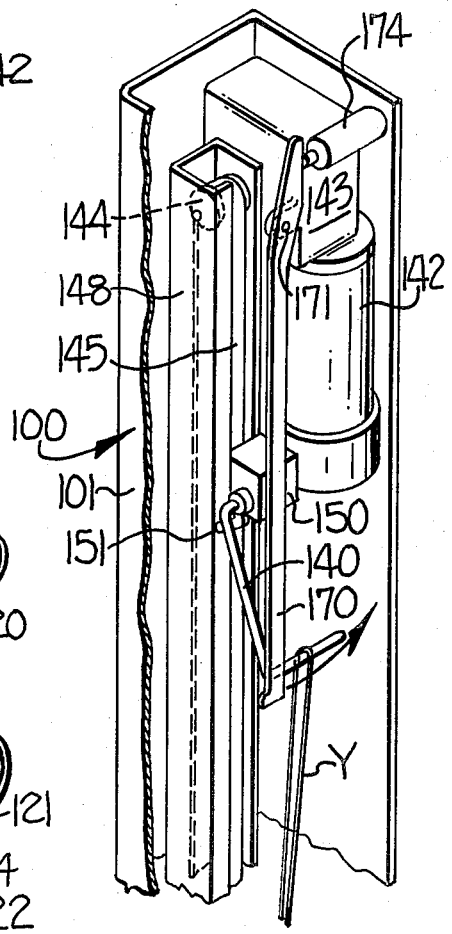
FIG. 11 is a partial perspective view of the take-up means in its second position after taking-up a loop of a predetermined length of yarn.
Figure 13:
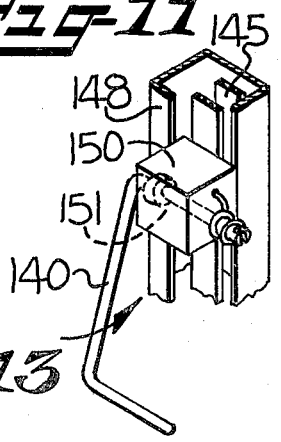
FIG. 13 is a partial perspective detail illustrating portions of the take-up means.

Substantially simultaneously with the above, means are provided for releasing the loop of yarn Y from the hook member 140 which is in its upper position for presentation in a substantially tension-free condition of the taken-up loop of yarn Y to the spindle assembly 10 for the above-described threading-up operation. This means for releasing the loop of yarn Y from the hook member 140 may be in the form of a finger 170 pivotally mounted on the gear box 143 at 171 (FIGS. 11 and 12) which may be moved by an electrically actuated solenoid device 174 or other suitable means for pivotal movement to engage the upper end of the loop of yarn Y being held by the hook member 140 and slide the loop of yarn Y off of the end of the hook member 140 (FIGS. 11 and 12).

There is preferably provided a retaining lug device 176, which is in the form of a generally L-shaped lever, pivotally mounted generally centrally thereof at 177 to the housing 101. The other end of the retaining lug device 176 is pivotally connected at 178 to an actuating rod 179 which extends into the gear box drive mechanism 143 and is actuated thereby to move the free end of the retaining lug 176 out of its central position (FIG. 8) into a laterally displaced position. During this movement, the free end of the retaining lug 176 engages the yarn Y prior to ejection of the free end of the yarn Y from the clamping means 106, 111 to shift the yarn Y out of the path of the air flow created by the ejection means and out of the suction created through the passageway 31 of the yarn entry tube 30 in the spindle assembly 10 (FIG. 10) so that the loop of yarn Y formed by the take-up and supply mechanism 100 does not obstruct the ejection of the free end of yarn Y by the ejecting means from the clamping means 106, 111 and receipt thereof by the suction created through the yarn entry tube 30 of the spindle assembly 10 by the pneumatic threading mechanisms. Additionally, the retaining lug device 176 exerts a certain restraining force on the yarn shifted out of its central position to prevent an uncontrolled tightening of the yarn as a result of natural suction produced by the spindle assembly 10, such as when the spindle assembly 10 is operating without a flyer 37 as is sometimes utilized in the case of the supply package P comprising two superimposed packages or cheeses of yarn Y.

Additionally, when the yarn take-up and supply mechanism 100 of this invention is utilized with a two-for-one twister textile yarn processing machine, such as illustrated in the drawings herein, it is preferable to provide a trolley mechanism 180 which is suitably mounted on rails 181, 182 by wheels or rollers 183, 184 for movement along each side of the yarn processing machine and along each of the spindle assembly stations 10 so that the yarn take-up and supply mechanism 100 may be positioned in front of a respective spindle assembly 10 when a threading-up operation is desired. As illustrated in the drawings herein, the connector 65 of the spindle assembly threading mechanisms may also be carried by the trolley mechanism 180 for desired positioning at a specific spindle assembly location when the threading-up operation is desired. The trolley may be driven by a drive motor 186 for automatic positioning.

The yarn take-up and supply mechanism 100 of this invention may include a suitable control circuit or other type of control mechanism (not shown) for effecting automatic operation of the above-described yarn take-up and supply operation of the mechanism 100 of this invention along with the spindle assembly threading mechanisms; however, such a control mechanism does not form a specific part of the present invention and will not be described herein.

As may be seen from the above description, a cycle of operation of the mechanisms of this invention is generally, as follows.

When a take-up package of yarn Y has been doffed from a particular spindle assembly 10 of the textile yarn processing machine following yarn processing thereof or when a yarn Y being processed has broken and a threading-up operation through the spindle assembly 10 by the pneumatic threading mechanisms is desired, the free end of yarn Y is pulled from the supply package P and inserted into the yarn grip 71. The trolley mechanism 180 carrying the yarn take-up and supply mechanism 100 of this invention, as well as the pneumatic threading connector device 65, will then be suitably positioned either manually or automatically in front of the particular spindle assembly 10. The connector mechanism 65 is inserted into the aperture 67 creating a threading-up airstream through the yarn passageway 31, 20 of the spindle assembly 10.

When this occurs, the yarn take-up and supply mechanism 100 is operated. The first member 106 of the clamping means 106, 111 is in its first, lowered position (FIG. 2) closely adjacent the free end of yarn Y extending downwardly from the yarn grip 71. The pneumatic injector means are actuated to cause a flow of air through the injector nozzle 115 and through the hollow interior 109 of the first member 106 of the clamping means to suck the free end of yarn Y into the forward end 107, through the hollow interior 109 and out of the rear end 108 of the first member 106 of the clamping means. The clamping means is then raised by cylinder and piston mechanism 120, 121 through guide groove 123 and guide pin 124 to its upper or second position (FIG. 5) so that the rear end 108 of the first member 106 is in engagement with the forwardly extending clamping plate 132 of the clamping means 106, 111 for clamping engagement to clamp the free end of yarn Y extending outwardly from the rear end 108 of the first member 106 of the clamping means.

The hook member 140 is then actuated for movement from its first position to its second position by the motor 142, gear box 143 and belt 145 to pivot around the outside of the U-shaped guide 148 (FIGS. 7 and 8) to engage the yarn Y inwardly of its clamped free end and move upwardly to its second position (FIG. 11) to form a loop of yarn Y of a predetermined length.

The housing 101 has been pivoted to its forward position (FIGS. 6 and 10) by the piston and cylinder mechanism 104 and the clamping plate 132 is moved to its rearward position (FIG. 10) out of clamping engagement with the first member 106. The retaining lug device 176 moves the yarn Y into an unobstructing position and pneumatic ejector means are actuated by causing a flow of air through the aperture 161 in the rearwardly positioned clamping plate 132 to cause an air flow through the hollow interior 109 of the first member 106 of the clamping means 106, 111 to eject the previously clamped free end of yarn Y from the clamping means for receipt by the suction created through the yarn passageway 31 in the yarn entry tube 30 of the spindle assembly 10.

Substantially simultaneously, the finger 170 is moved to engage the yarn Y being held by the hook member 140 to remove the yarn Y therefrom and release the taken-up loop of yarn for presentation to the spindle assembly 10 in a substantially tension-free condition (broken line position of FIG. 12) for continued pneumatic threading of the yarn Y through the spindle assembly 10 and the take-up and supply mechanism 100 is moved back to its starting position (solid line position of FIG. 12).

In the drawings and specification there has been set forth a preferred embodiment of the invention and, although specific terms are employed, they are used in a generic and descriptive sense only and not for purposes of limitation.

What is claimed is:

1. A yarn take-up and supply mechanism for selected intermittent use with textile machines utilizing yarn, such as during a threading-up operation of the machine, characterized by a construction for receiving a free end of yarn from the textile machine, taking-up a loop of a predetermined length of the yarn and completely releasing the free end and taken-up length of yarn to the textile machine in a substantially tension-free condition, said mechanism comprising:

housing means;

clamping means carried by said housing means for receiving the free end of yarn extending from the textile machine and for clamping the free end of the yarn;

driven take-up means carried by said housing means for engaging the yarn inwardly of the clamped free end and for moving away a predetermined distance to carry the yarn and form a loop of a predetermined length of the yarn;

means carried by said housing means for releasing said clamping means and the free end of yarn for presentation to the textile machine; and means carried by said housing means for releasing the loop of yarn from said take-up means for presentation in a substantially tension-free condition to the textile machine.

2. In a textile yarn processing machine, such as a two-for-one twister or the like, having a plurality of spindle assemblies each including a driven rotating rotor mechanism, a stationary carrier mechanism for carrying a hollow supply package of yarn, and an elongate yarn passageway passing downwardly through the top of said carrier mechanism along the axis of said spindle assembly and radially outwardly through said rotor mechanism for receiving the yarn from the supply package therethrough and then upwardly along the outside of said carrier mechanism for forming a rotating balloon of yarn during yarn processing, and having selectively-operable pneumatic threading mechanisms for being operated to automatically thread yarn withdrawn from the supply package through said passageway during threading-up of said spindle assembly by creating a suction through the yarn entry portion of said passageway and a positive air stream through the yarn exit portion of said passageway; the combination therewith of a yarn take-up and supply mechanism for cooperation with said threading mechanisms and being characterized by a construction for receiving a free end of the yarn as it emerges from the supply package, taking-up a loop of a predetermined length of the yarn and completely releasing the free end and taken-up length of the yarn to the textile machine in a substantially tension-free condition at the yarn entry portion of said passageway through said spindle assembly for receipt by said threading mechanisms for threading-up of said textile yarn processing machine, said yarn take-up and supply mechanism comprising:

housing means;

clamping means carried by said housing means for receiving the free end of yarn extending from the supply package in said spindle assembly of said textile machine and for clamping the free end of the yarn;

driven take-up means carried by said housing means for engaging the yarn inwardly of the clamped free end and for moving away a predetermined distance to carry the yarn and form a loop of predetermined length of the yarn;

means carried by said housing means for releasing said clamping means and the free end of yarn for presentation to the textile machine at the area of the yarn entry portion of said passageway of said spindle assembly of said textile machine; and means carried by said housing means for releasing the loop of yarn from said take-up means for presentation in a substantially tension-free condition to the textile machine.

3. A yarn take-up and supply mechanism, as set forth in claims 1 or 2, in which said mechanism further includes yarn injector/ejector pneumatic means operatively associated with said clamping means for selectively creating a suction air flow to inject the free end of yarn from the textile machine into said clamping means and for subsequently selectively creating a positive air flow to eject the free end of yarn from said clamping means back to the textile machine after said take-up means has formed a loop of a predetermined length of the yarn.

4. A yarn take-up and supply mechanism, as set forth in claim 1 or 2, in which said clamping means comprises:

a first member carried by said housing means and having a front end, a rear end and a hollow interior for receiving the free end of yarn at said forward end to extend through said hollow interior and out of said rear end, and a second member mounted for movement between a clamping position in engagement with said rear end of said first member and a non-clamping position out of such engagement.

5. A yarn take-up and supply mechanism, as set forth in claim 4, in which said mechanism further includes pneumatic yarn injector means comprising injector nozzle means formed within said hollow interior of said first member of said clamping means for selectively creating an air flow through said hollow interior from said front end to said rear end of said first member of said clamping means for injecting the free end of yarn from the textile machine into said clamping means when said first and second members of said clamping means are in the non-clamping position; and pneumatic yarn ejector means comprising means for selectively creating a positive air flow through said hollow interior of said first member of said clamping means from said rear end to said front end for ejecting the free end of yarn from the clamping means back to the textile machine when said first and second members of said clamping means are in the non-clamping position.

6. A yarn take-up and supply mechanism, as set forth in claim 5, in which said means for selectively creating a positive air flow through said hollow interior of said first member of said clamping means for ejecting the free end of yarn from said clamping means comprises means formed within said second member of said clamping means for creating a positive flow of air out of said second member through said hollow interior of said first member when said first and second members of said clamping means are in the non-clamping position.

7. A yarn take-up and supply mechanism, as set forth in claim 5, in which said first member of said clamping means is movable from a first position during which said pneumatic injector means is selectively actuated for injecting the yarn from the textile machine into said first clamping member to a second position in clamping engagement with said second member after the yarn has been injected therein for clamping engagement of the yarn, and said second member being movable from the clamping position with said first member to a non-clamping position out of such clamping engagement during which said pneumatic yarn ejector means is selectively actuated to eject the yarn from said clamping means while said first and second clamping members are out of clamping engagement.

8. A yarn take-up and supply mechanism, as set forth in claim 7, in which said clamping means further includes pneumatic piston and cylinder means, one of which is mounted to said housing means and the other of which is mounted on said first member of said clamping means for pneumatic actuation to move said first member of said clamping means between its first and second position, and guide means comprising a guide groove formed in said housing means and pin means secured to the one of said piston and cylinder means connected to said first member of said clamping means and riding in said groove means for guiding said first member of said clamping means between its first and second positions under control of said pneumatic piston and cylinder means.

9. A yarn take-up and supply mechanism, as set forth in claim 8, in which said mechanism further includes means mounting said housing means for pivotal movement between a first position during which the yarn is injected into said clamping means by said pneumatic injector means, clamped by said first and second members of said clamping means and a loop of a predetermined length of the yarn has been formed by said take-up means, to a second positon for ejecting of the free end of yarn and the loop of a predetermined length of the yarn by said pneumatic ejecting means to another desired position in the textile machine, and means for moving said housing means between the first and second positions thereof.

10. A yarn take-up and supply mechanism, as set forth in claims 1 or 2, in which said driven take-up means comprises a generally L-shaped hook member for engaging at one end thereof the yarn inwardly of the clamped free end thereof, and means carried by said housing means and mounting the other end of said hook member for moving said hook member along a generally linear path of travel from a first position when said hook member initially engages the yarn to a second position a predetermined distance away to carry the yarn and form a loop of a predetermined length of the yarn.

11. A yarn take-up and supply mechanism, as set forth in claim 10, in which said means for moving said hook member between its first and second positions comprises motor means, belt means driven by said motor means and extending along the linear path of travel of said hook member, and mounting means carried by said belt means and mounting the other end of said hook member for carrying said hook member along its path of travel between its first and second positions.

12. A yarn take-up and supply mechanism, as set forth in claims 1 or 2, in which said means for releasing the loop of yarn from said take-up means comprises a selectively movable finger member having one end thereof mounting said finger member to said housing means for movement of the other end thereof between a first position and a second position during which the other end of said finger means engages the loop of yarn and removes the loop of yarn from said take-up means.

13. In a textile yarn processing machine, as set forth in claim 2, in which said mechanism further includes a trolley mechanism movably mounted along said textile yarn processing machine and extending along each of said plurality of spindle assemblies and movably carrying said yarn take-up and supply mechanism so that said yarn take-up and supply mechanism may be selectively positioned in front of a respective spindle assembly when a threading-up operation thereof is desired.

14. A yarn take-up and supply mechanism for selected intermittent use with textile machines utilizing yarn, such as during a threading-up operation of the machine, characterized by construction for receiving a free end of yarn from the textile machine, taking-up a loop of a predetermined length of the yarn and completely releasing the free end and taken-up length of yarn to the textile machine in a substantially tension-free condition, said mechanism comprising:

housing means including means mounting said housing means for movement between a first position for receiving the yarn from the textile machine and a second position for releasing the free end and taken-up length of yarn to the textile machine;

clamping means carried by said housing means for receiving the free end of yarn extending from the textile machine and for clamping the free end of the yarn comprising a first member carried by said housing means and having a front end, a rear end and a hollow interior for receiving the free end of yarn at said forward end to extend through said hollow interior and out of said rear end, and a second member mounted for movement between a clamping position in engagement with said rear end of said first member in a non-clamping position out of such engagement;

pneumatic yarn injector means comprising injector nozzle means formed within said hollow interior of said first member of said clamping means for selectively creating an air flow through said hollow interior from said front end to said rear end of said first member of said clamping means for injecting the free end of yarn from the textile machine into said clamping means when said first and second members of said clamping means are in the non-clamping position;

take-up means comprising a generally L-shaped hook member for engaging at one end thereof the yarn inwardly of the clamped free end thereof, and means carried by said housing means and mounting the other end of said hook member for moving said hook member along a generally linear path of travel from a first position when said hook member initially engages the yarn to a second position a predetermined distance away to carry the yarn therewith and form a loop of a predetermined length of the yarn;

means operatively associated with said clamping means for selectively releasing said clamping means and the free end of yarn for presentation to the textile machine;

pneumatic yarn ejector means comprising means for selectively creating a positive air flow through said hollow interior of said first member of said clamping means from said rear end to said front end for ejecting the free end of yarn from said clamping means back to the textile machine when said first and second members of said clamping means are in the non-clamping position; and means carried by said housing means for releasing the loop of yarn from said hook member of said take-up means for presentation in a substantially tension-free condition to the textile machine.

15. In a textile yarn processing machine, such as a two-for-one twister or the like, having a plurality of spindle assemblies each including a driven rotating rotor mechanism, a stationary carrier mechanism for carrying a hollow supply package of yarn, and an elongate yarn passageway passing downwardly through the top of said carrier mechanism along the axis of said spindle assembly and radially outwardly through said rotor mechanism for receiving the yarn from the supply package therethrough and then upwardly along the outside of said carrier mechanism for forming a rotating balloon of yarn during yarn processing, and having selectively-operable pneumatic threading mechanisms for being operated to automatically thread yarn withdrawn from the supply package through said passageway during threading-up of said spindle assembly by creating a suction through the yarn entry portion of said passageway and a positive air stream through the yarn exit portion of said passageway; the combination therewith of a yarn take-up and supply mechanism for cooperation with said threading mechanisms and being characterized by a construction for receiving a free end of the yarn as it emerges from the supply package, taking-up a loop of a predetermined length of the yarn and completely releasing the free end and taken-up length of the yarn to the textile machine in a substantially tension-free condition at the yarn entry portion of said passageway through said spindle assembly for receipt by said threading mechanisms for threading-up of said textile yarn processing machine, said yarn take-up and supply mechanism comprising:

housing means including means mounting said housing means for movement between a first position for receiving the yarn withdrawn from the supply package in the textile machine and a second position for releasing the free end and taken-up length of yarn to the yarn entry portion of said passageway through said spindle assembly of said textile machine;

clamping means carried by said housing means for receiving the free end of yarn from the supply package within said textile machine and for clamping the free end of yarn comprising a first member carried by said housing means and having a front end, a rear end and a hollow interior for receiving the free end of yarn at said forward end and to extend through said hollow interior and out of said rear end, and a second member mounted for movement between a clamping position in engagement with said rear end of said first member and a non-clamping position out of such engagement;

pneumatic yarn injector means comprising injector nozzle means formed within said hollow interior of said first member of said clamping means for selectively creating an air flow through said hollow interior from said front end to said rear end of said first member of said clamping means for injecting the free end of yarn from the supply package within said textile machine into said clamping means when said first and second members of said clamping means are in the non-clamping position.

take-up means comprising a generally L-shaped hook member for engaging at one end thereof the yarn inwardly of the clamped free end thereof, and means carried by said housing means and mounting the other end of said hook member for moving said hook member along a generally linear path of travel from a first position when said hook member initially engages the yarn to a second position a predetermined distance away to carry the yarn therewith and form a loop of a predetermined length of the yarn;

means operatively associated with said clamping means for selectively releasing said clamping means and the free end of yarn for presentation to the textile machine;

pneumatic yarn ejector means comprising means for selectively creating a positive air flow through said hollow interior of said first member of said clamping means from said rear end to said front end for ejecting the free end of yarn from said clamping means back to said textile machine when said first and second members of said clamping means are in the non-clamping position; and means carried by said housing means for releasing the loop of yarn from said hook member of said take-up means for presentation in a substantially tension-free condition to the yarn entry portion of said yarn passageway through said spindle assembly of said textile machine.

16. A yarn take-up and supply mechanism, as set forth in claims 14 or 15, in which said first member of said clamping means is movable from a first position, during which said pneumatic injector means is selectively actuated for injecting the yarn from the textile machine into said first clamping member, to a second position in clamping engagement with said second member after the yarn has been injected therein for clamping engagement of the yarn, said second member includes means for moving said second member from the clamping position with said first member to the non-clamping position out of such clamping engagement during which said pneumatic yarn ejector means is selectively actuated to eject the yarn from said clamping means, said clamping means further including pneumatic piston and cylinder means, one of which is mounted to said housing means and the other of which is mounted on said first member of said clamping means for pneumatic acutation to move said first mmber of said clamping means between its first and second positions, and guide means comprising a guide groove formed in said housing means and pin means secured to the one of said piston and cylinder means connected to said first member of said clamping means and riding in said groove means for guiding said first member of said clamping means between its first and second positions under control of said pneumatic piston and cylinder means.

17. A yarn take-up and supply mechanism, as set forth in claim 16, in which said second member of said clamping means comprises a housing, a moveable plate means carried by said housing for movement between the clamping position in engagement with said rear end of said first member of said clamping means to the non-clamping position out of engagement with said rear end of said first member of said clamping means, and means for moving said clamping plate between its first and second positions;

said means for selectively creating a positive air flow through said hollow interior of said first member of said clamping means for ejecting the free end of yarn from said clamping means comprises means formed within said second member of said clamping means and through said clamping plate thereof for creating a positive flow of air out of said second member of said clamping means through said hollow interior of said first member when said first and second members of said clamping means are in the non-clamping position.

18. A yarn take-up and supply mechanism, as set forth in claims 14 or 15, in which said means for releasing the loop of yarn from said take-up means comprises a selectively moveable finger member having one end thereof mounting said finger member to said housing means for movement of the other end thereof between a first position and a second position during which the other end of said finger means engages the loop of yarn and removes the loop of yarn from said hook member of said take-up means.

19. In a textile yarn processing machine, as set forth in claim 15, further including a trolley mechanism movably mounted along said textile yarn processing machine and extending along each of said plurality of spindle assemblies and movably carrying said yarn take-up and supply mechanism so that said yarn take-up and supply mechanism may be positioned in front of a respective spindle assembly when a threading-up operation thereof is desired.

20. In a textile yarn processing machine, such as a two-for-one twister or the like, the combination of:

a plurality of spindle assemblies mounted in generally side-by-side relationship along the outside of said machine and each including a driven rotating rotor mechanism, a stationary carrier mechanism for carrying a hollow supply package of yarn, and an elongate yarn pasageway extending downwardly through the top of said carrier mechanism along the axis of said spindle assembly and radially outwardly through said rotor mechanism for receiving the yarn from the supply package therethrough during yarn processing;

selectively-operable pneumatic threading means for being operated to automatically thread yarn withdrawn from the supply package through said yarn passageway during threading-up of said spindle assembly by creating a suction through the yarn entry portion of said passageway and a positive airstream through the yarn exit portion of said passageway; and yarn take-up and supply means cooperating with said threading means and including means for receiving a free end of yarn from the supply package carried by said carrier mechanism, means for taking-up a loop of a predetermined length of the yarn, and means for releasing and conveying the free end and taken-up length of yarn in a substantially tension-free condition to the yarn entry portion of said yarn passageway through said spindle assembly for receipt by the suction created therethrough by said pneumatic threading means.

21. In a textile yarn processing machine, as set forth in claim 20, further including a trolley means mounted for movement along the outside of said textile yarn processing machine and along the front of each of said spindle assemblies and carryng said yarn take-up and supply means so that said yarn take-up and supply means may be conveniently positioned in front of a respective spindle assembly when a yarn take-up and supply operation is desired.

* * * * *